US005802793A

United States Patent [19]

DeVore, Jr.

[11] Patent Number: 5,802,793

[45] Date of Patent: Sep. 8, 1998

[54] PRECAST MODULAR KEYED BUILDING SYSTEM

[76] Inventor: Walter Don DeVore, Jr., P.O. Box 35, Idaho Springs, Colo. 80452

[21] Appl. No.: 748,932

[22] Filed: Nov. 14, 1996

[51] Int. Cl.[6] ..... E04B 2/30

[52] U.S. Cl. ..... 52/424; 52/426; 52/427; 52/428; 52/430; 52/586.1

[58] Field of Search ..... 52/424, 426, 586.2, 52/427, 430, 428, 586.1

[56] References Cited

U.S. PATENT DOCUMENTS

| | | | |
|---|---|---|---|
| 3,276,797 | 10/1966 | Humes, Jr. | 52/586.1 X |
| 5,038,541 | 8/1991 | Gibbar, Jr. | 52/426 X |
| 5,040,344 | 8/1991 | Durand | 52/426 X |
| 5,459,970 | 10/1995 | Kim | 52/426 X |
| 5,488,806 | 2/1996 | Melnick et al. | 52/424 X |

*Primary Examiner*—Christopher Kent

[57] ABSTRACT

A wall system utilizing a plurality of precast concrete panels so that a parallel inside wall and outside wall is created. Each panel of the plurality has a continuous slot on all four perimeter sides that mutually oppose slots on adjacent panels. A strip fits into the slot formed by the two abutting panels, thus aligning, reinforcing, and sealing the plurality. The outside wall is connected to the inside wall by one or more embedded protrusions from said opposite panels so that said protrusions overlap upon each other. The overlap is then fastened together by a chosen method, for example a bolt and nut which may include washers or spot welding areas of intersection yielding a rigid bridge between the opposite panels.

18 Claims, 10 Drawing Sheets

PRECAST MODULAR KEYED BUILDING SYSTEM

FIELD OF THE INVENTION

This invention relates to the construction industry wherever vertical partitions are required. These may be building walls, fences, sound barriers, or enclosures.

DESCRIPTION OF THE PRIOR ART

The common method of wall building has remained virtually unchanged in the post World War II era since the advent of the wood framed tract house.

The need for improvement in recent time has been evidenced by multitudes of alternatives now manifesting. These alternatives include straw bale, discarded tires, rammed earth, tilt up, domes, and now very recently insulated stay in place forms for concrete walls.

In Melnick's U.S. Pat. No. 5,488,806 a braced foam block wall system is used as a receptacle for concrete. In the claims a block aligning system is described that utilizes a "T" cross section that provides a cap, base, aligning, and reinforcing mechanism. It provides substantial structural performance to the system as the foam blocks of themselves provide little strength. The connectors are a separate piece placed and pinned to the blocks and providing union to each side of the formed cavity. A supporting cable attaches to the connector to brace the lightweight system against the denser mass of added concrete. As the block is weak in relation to its' purpose, any embedded fastening means are not possible and separate higher strength connectors must be used.

In Durand's U.S. Pat. No. 5,040,344 another insulating form system is described. The connecting means also utilizes an external piece "T" cross section that provides platform, alignment, connective attachment across the formed cavity and a connective means to external shoring. Although it utilizes grooves in the blocks, the connective means must incorporate the "T" cross section as it is necessary to carry out said multiple functions.

In Gibbar Jr.'s U.S. Pat. No. 5,038,541 another similar system is described, with the addition of interior partitions to decrease the amount of concrete added to fill a formed wall.

In Kim's U.S. Pat. No. 5,459,970 the foam wall concrete form system is replaced by a precast concrete wall forming system. This is a complex system. It utilizes an embedded wire system to which a separate connective brace is attached. The fact that attachment and coupling members are supplemental to any embedded pieces keeps this invention a level of complexity above this currently applied for invention.

SUMMARY OF THE INVENTION

This invention is a way to make and assemble masony manufactured concrete units so that a complete wall system is accomplished, including window and door openings. A continuous hollow cavity in the wall is created, by assembly and this space is available for multitudes of uses in wall systems and applications. Slots machined into perimeter surfaces of the components that receive a strip provide alignment, sealing, wall face joinery, and reinforcement. Embedded perforated members provide for joinery of the wall panels across the cavity creating the exposed outside faces of the wall and the continuous cavity between them. For strength requirements beyond the panels themselves, interior columns are ready to be formed by the structure of the assembly. Horizontal beams or ductwork are also ready to be established by the structure of the assembly. Methods of tieing the wall system together both horizontally and vertically are also created by the basic assembly of the system.

The object of the system is to utilized lightweight concrete in a way that all components may be handled by an individual without the use of any mechanical assistance creating a user friendly system for the average constructor.

BEST MODE FOR CARRYING OUT THE INVENTION

Figure 1:
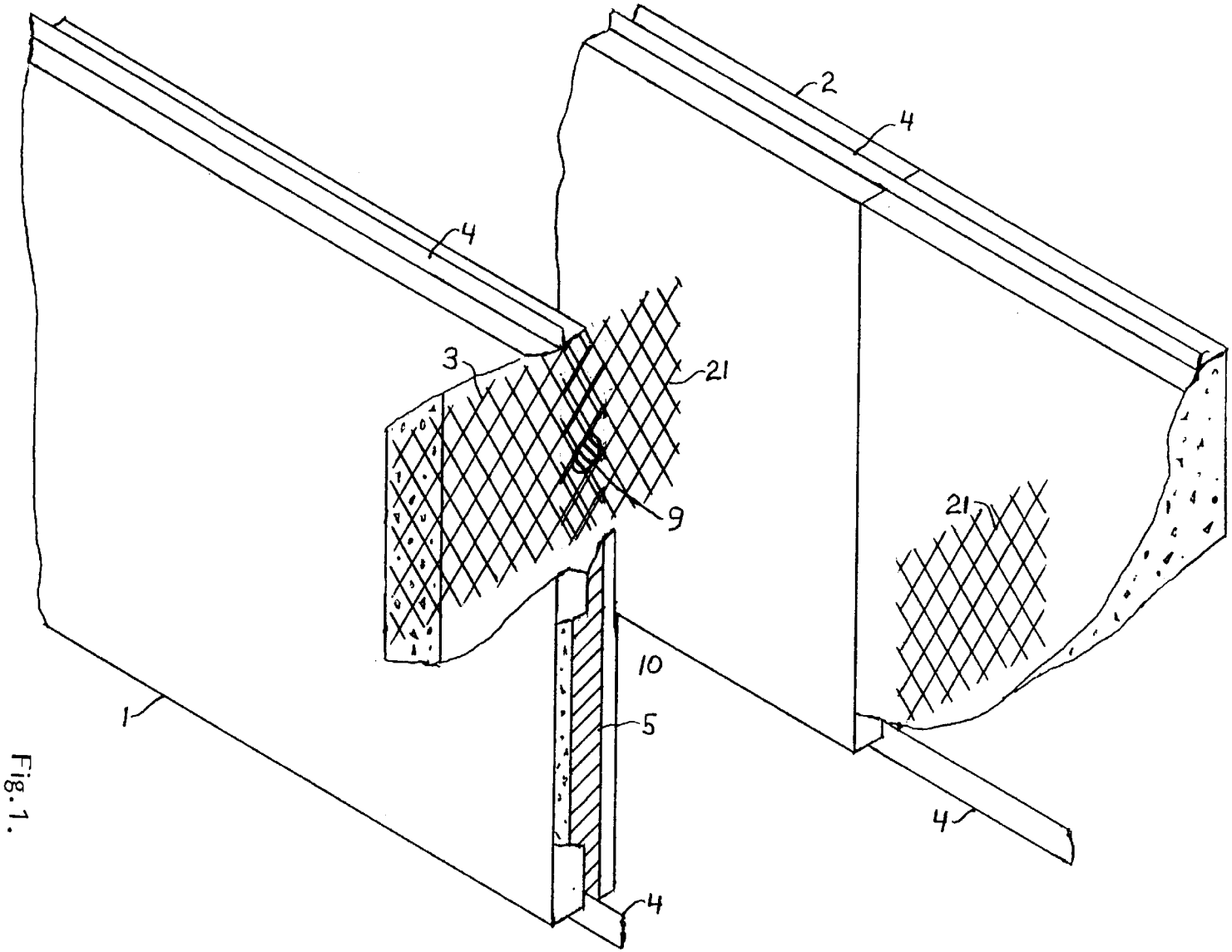
FIG. 1 is a perspective view of the wall structure showing the perimeter with the installed strips and the embedded pieces overlapping fastened together.
Figure 2:
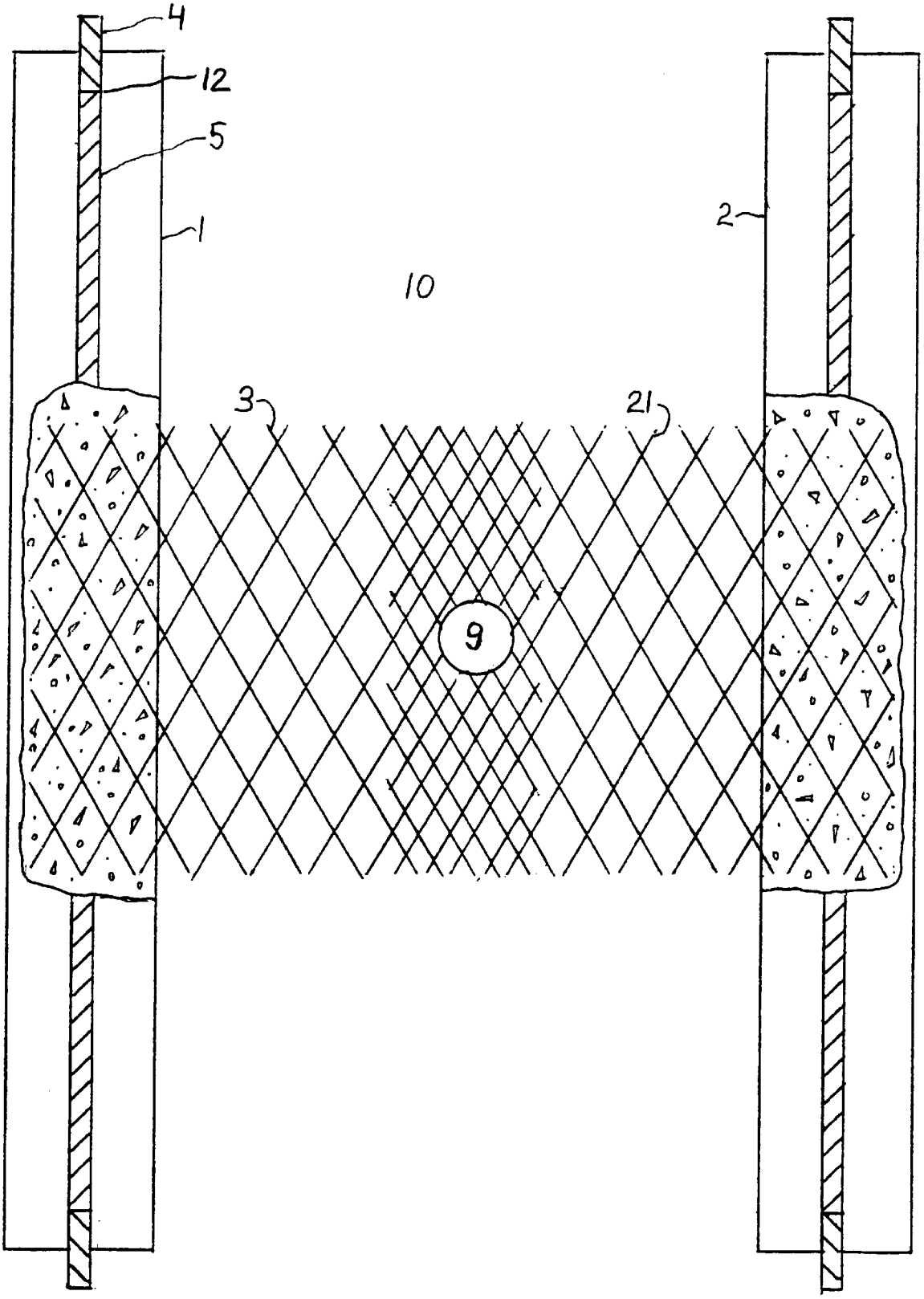
FIG. 2 is a cross section showing the connection within the cavity and the perimeter strips.
Figure 3:
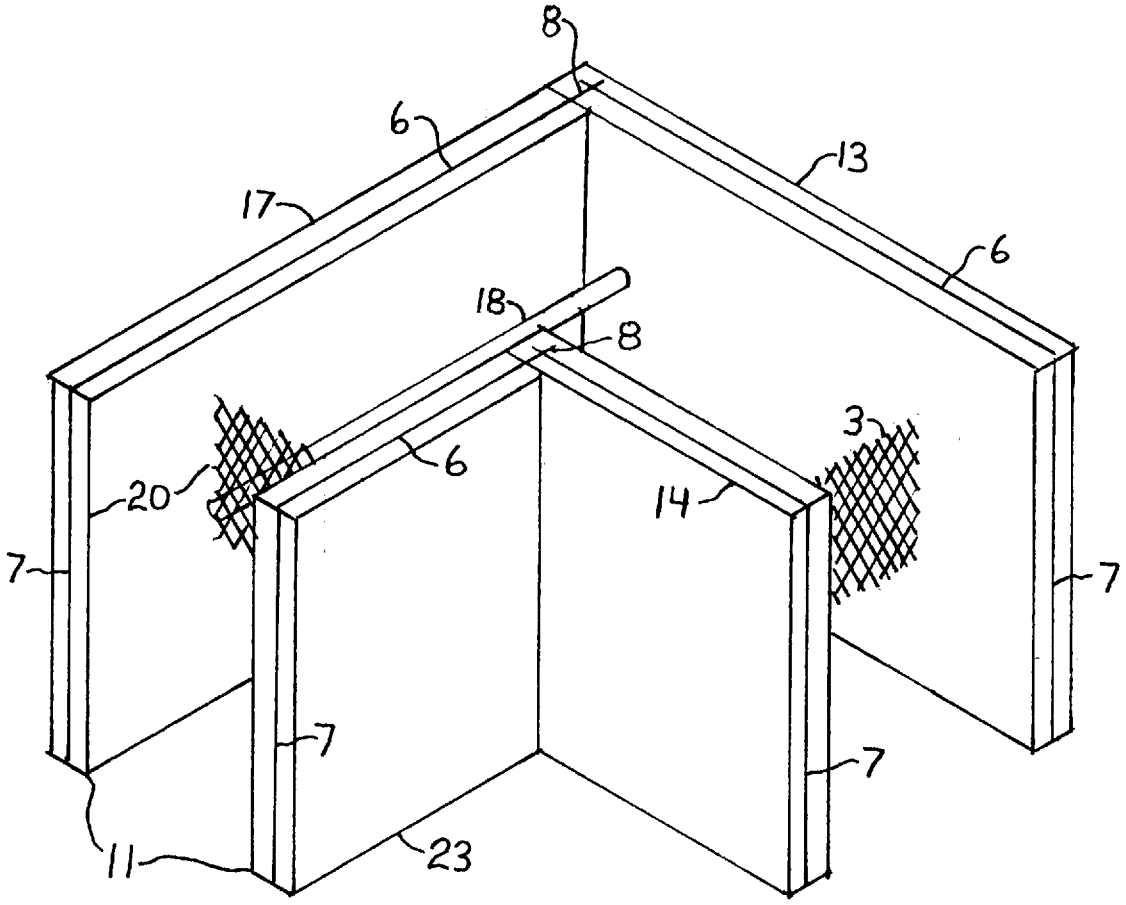
FIG. 3 is a perspective view showing a corner assembly.
Figure 4:
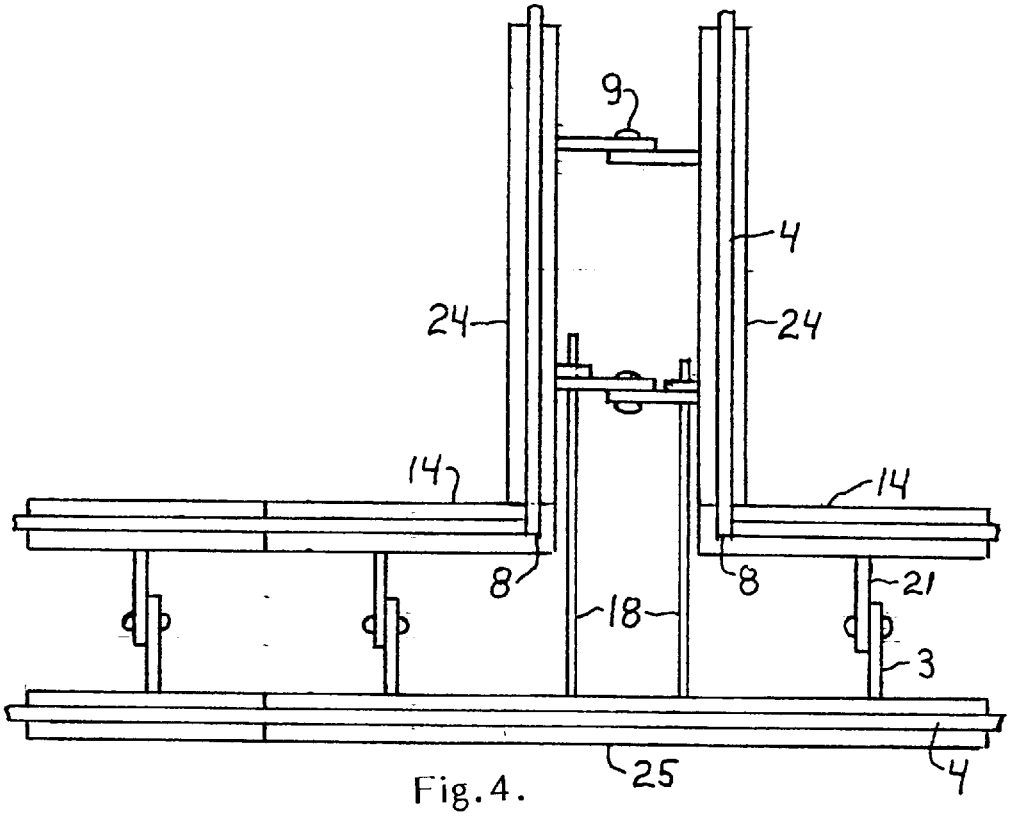
FIG. 4 is a top or bottom view of a T-intersection at level X.
Figure 5:
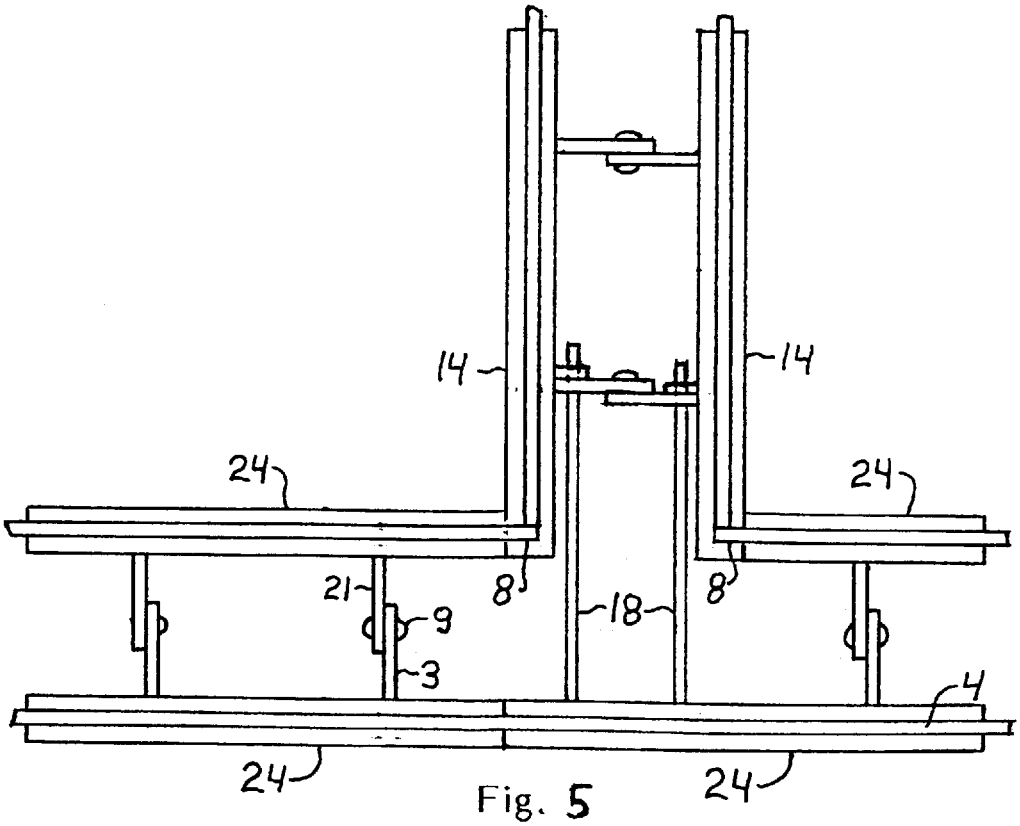
FIG. 5 is a top or bottom view of a T-intersection at level X±1.
Figure 6:
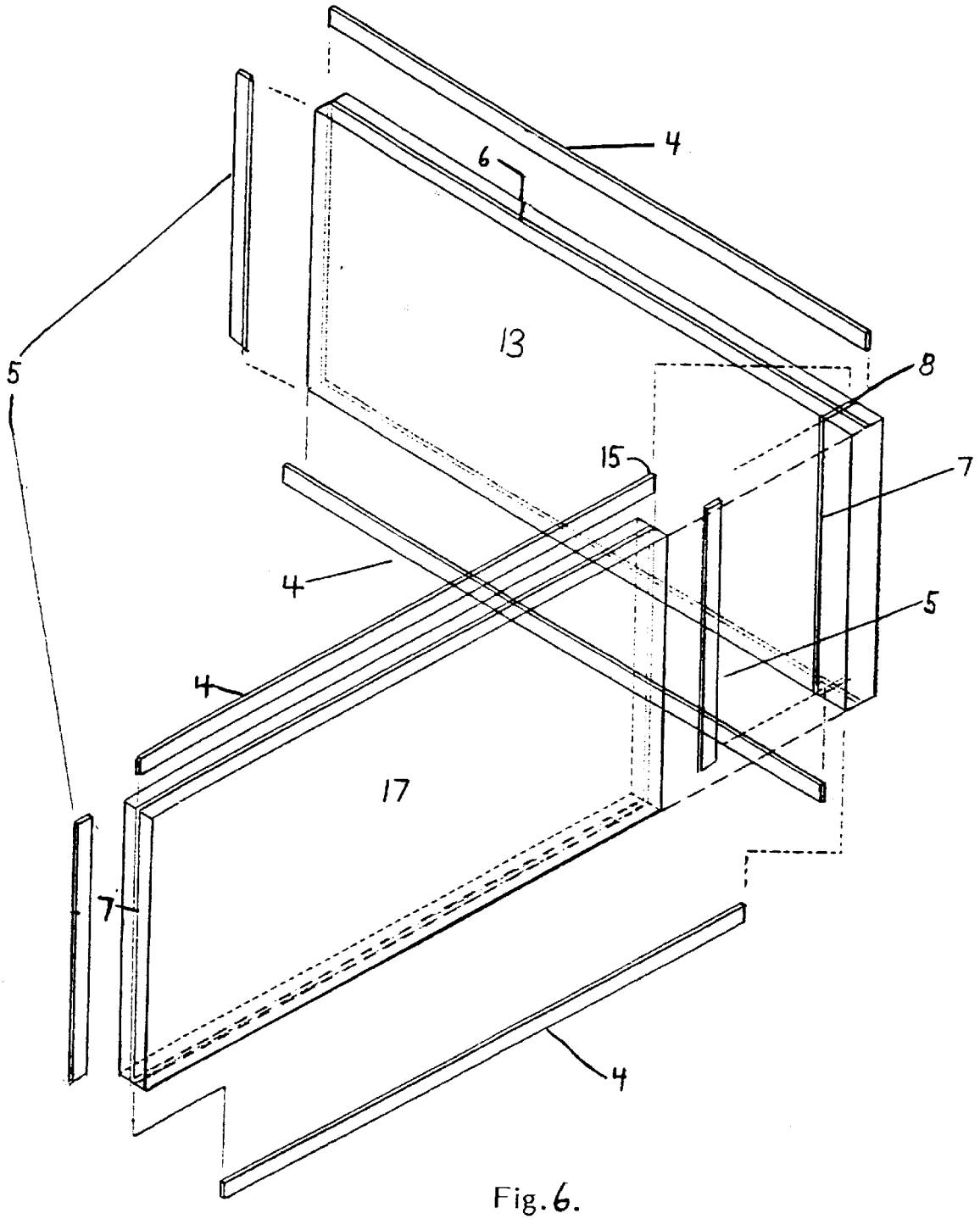
FIG. 6 is a perspective view detailing the strip and slot arrangement for corner assembly.
Figure 7:
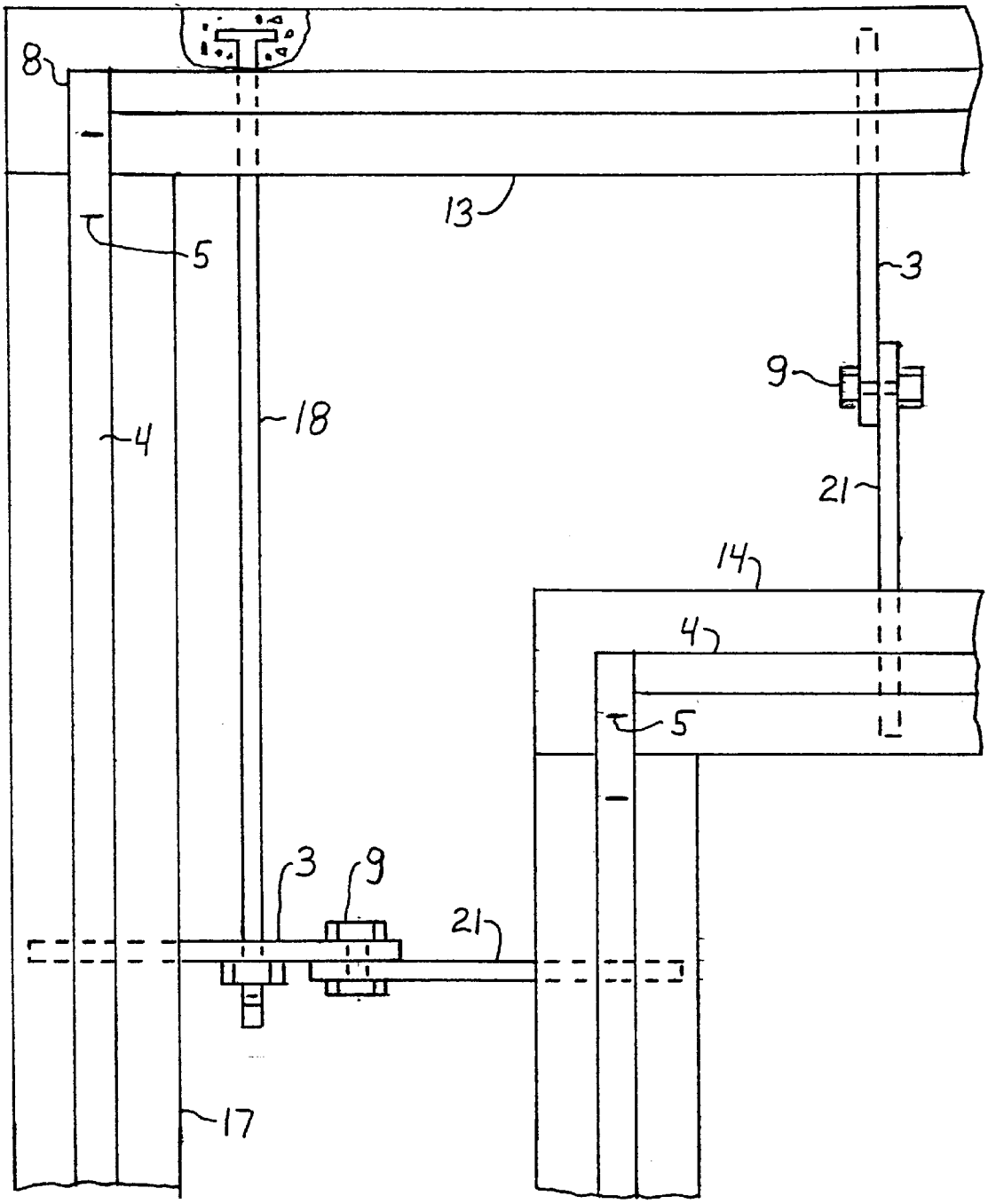
FIG. 7 is a top or bottom view of a corner assembly at level X.
Figure 8:
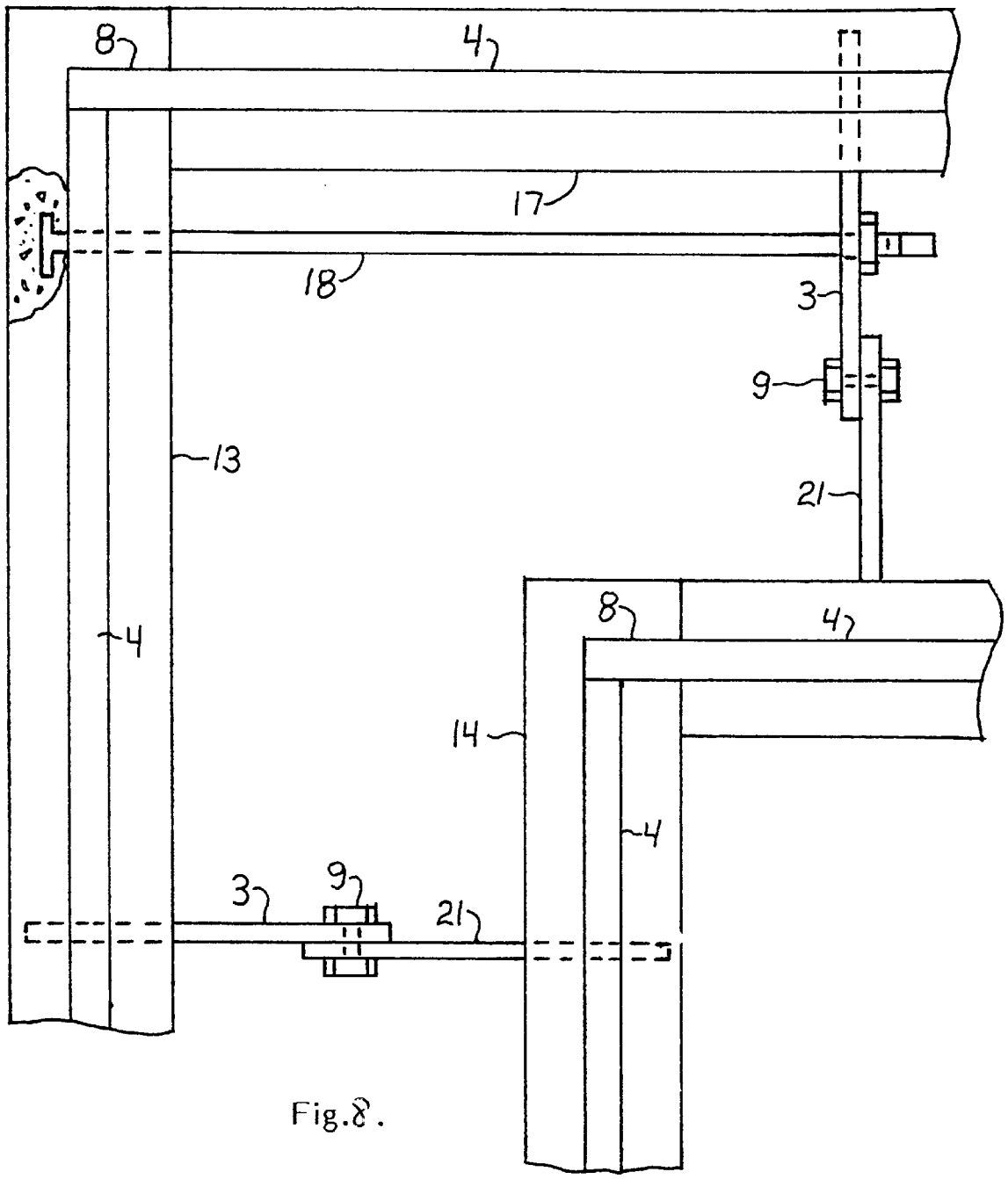
FIG. 8 is a top or bottom view of a corner assembly at level X±1.
Figure 9:
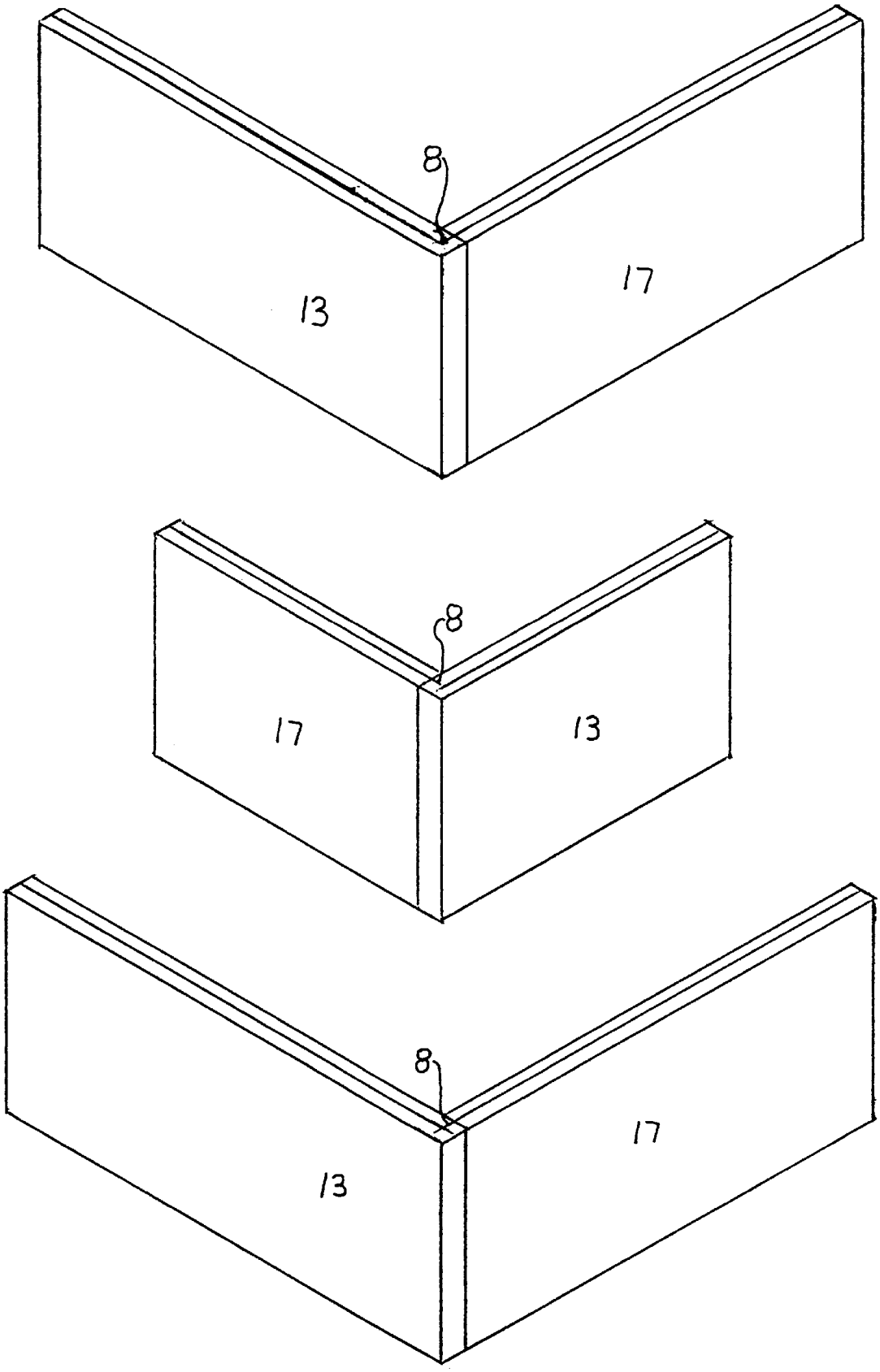
FIG. 9 is a perspective view showing how corners alternate overlapping one another.
Figure 10:
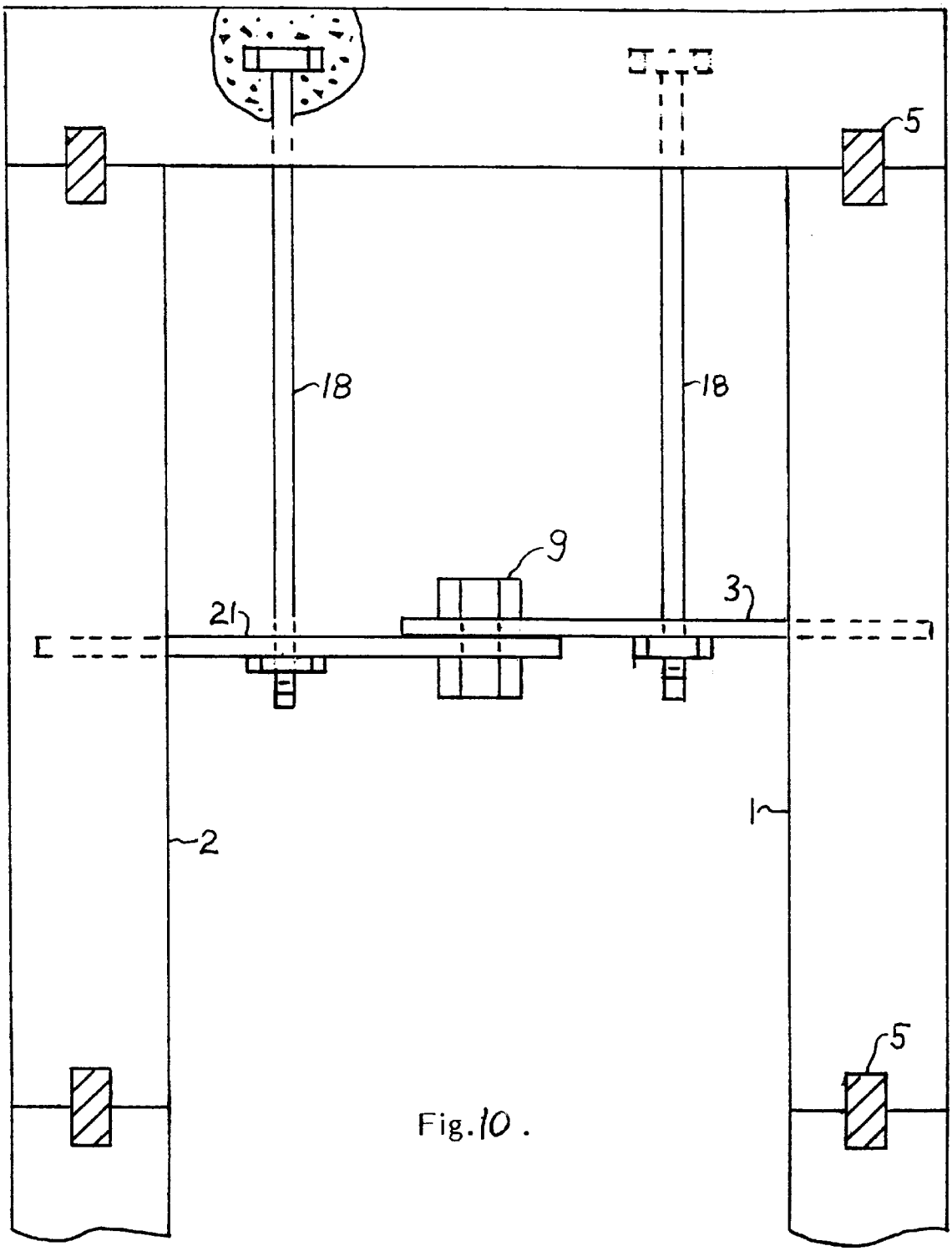
FIG. 10 is a top or bottom view showing how a wall length terminates allowing an opening to be created.
Figure 11:
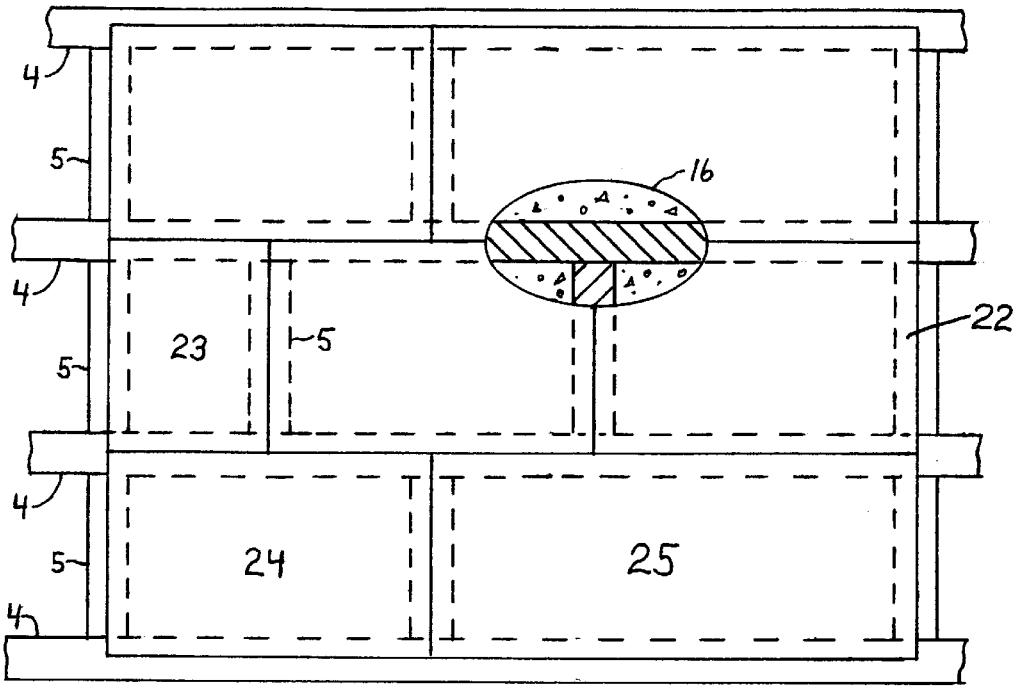
FIG. 11 is a front view showing how different length modules or increments are used so vertical joints may not be continuous from level X to level X±1.
Figure 12:
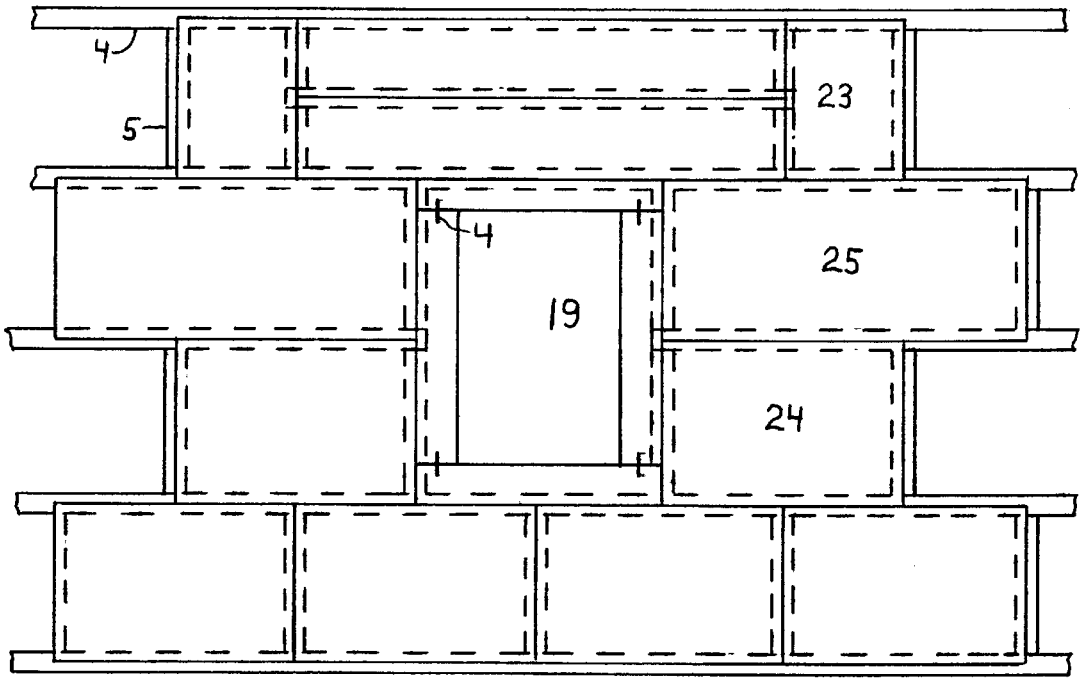
FIG. 12 is a front view showing how a wall opening may be created and how the slot/strip arrangement may be incorporated into the units comprising the opening.

In order to begin construction with this invention, a level concrete footing should be prepared.

The alignment of the slot 6 for each side of the wall (1,2) in order to give the desired cavity 10 width and total wall width 11 is marked upon the footing. An appropriate sawing device is used to machine the slot 12 to a depth of one half the height of the strip 4 and a width equal to the thickness of the strip 4 to be used. This is done to conform to specified tolerances. The slots 12 upon meeting each other at the corner 8 intersect each other.

This procedure is repeated for the other wall half. This procedure then continues until the entire wall system is delineated by slots installed into the supporting slab or footing. The strips 4 are now inserted into the slots where the wall construction will begin. One half the height of the strip 4 is seated into the slot 6 and the top half protrudes to receive the slot of the panel 1 to be installed over it.

Installation is begun at the corners. The perpendicular slot 8 on corner panel 13 is placed over strip 15. The panel length is aligned with strip 4 and now lowered so the strip is seated into the slot. With the achieved seating being both longitudinal and perpendicular it is locked into place.

A strip 5 is now installed into the vertical slot 7 of the installed corner panel 13. This strip may become flush with the top edge of the horizontal strip 4 below it. The strip 5 may be of a height so that the top of the strip 5 will be flush to the bottom edge of the horizontal strip 4 to be installed over it. By installing the strip in this manner a continuity of steel contact is achieved 16.

Corner panel 17 is now ready to be installed. Since the length to the vertex of the corner includes the thickness of corner panel 13 the length of panel 17 is decreased by that thickness. Panel 17 is positioned so that its lower corner has its slots (6,7) aligned with strips (4,5). It is pushed into place so its slots (6,7) are fully mated into strips (4,5). Embedded devices 18 may be used to vertically tie the wall together.

Another sequence for installation of 17 would be to not install strip 5. Then corner panel 17 would be placed onto only strip 4 and positioned flush with corner panel 13. The vertical slots 7 of panels (13,17) would now be aligned and strip 5 slid from the top down into the slot channel formed by both panels (13,17).

Subsequent wall panels are installed in similar circumstance. This continues until either a corner or a break in the wall such as an opening 19, for example a door or window opening, is reached. Thus, the length of wall is ready to seat into a perpendicular plane that spans the cavity. The disposition of said slots and strips continues.

This process will be concurrent with the procedure of installing the opposite wall face, which is the identical process of fitting panels, strips and slots together in said fashion.

This will by design consistency, which is placing embedded member 3 one half the amount of the horizontal increment, for example one foot yielding six inches, in from the panel vertical edge 20, align embedded member 3 with its opposite self 21. This opposite mate 21 may be of identical composition. With 3 and 21 now overlapping, they are ready to be fastened to each other. At this time strip 4 is installed so that it may become flush with each vertical strip 5 that it passes over. Installation of strip 4 enhances the straightness of alignment of the wall and reinforces the wall. An enclosing of the entire wall panel perimeter is accomplished 22. With the wall now being locked together in its own inner and outer planes, the planes now become mechanically fastened to each other with overlapping members (3,21). A fastening device 9, for example a nut bolt washer combination or riveting or spot welding, is now installed through (3,21) compressing them together.

Upon completion of one level of wall, a second level may be added above it. The upper strip of level one becomes the bottom strip in level two. Once again the corner may be considered first. The corner panels are juxtapositioned to the lower level. Panel 13 is placed over the length of panel 17 and the perpendicular orientation of panel 13 below. The relationship of panel 13 in level two to panel 13 in level one is that it's simply turned upside down. Panel 13 is lowered so its bottom slots engage the protruding top strips of level one and a flush coupling is achieved. Panel 13 is now fixed in position.

Construction of the remainder of this next level proceeds in identical manner to the previous level. By continuing this process, any height of wall can be attained that is a multiple of the height of the panels used.

Another aspect of this invention is that the lengths of the panels may be a one times, a two times, and a three times multiple of a desired horizontal unit, for example one foot which would create panels one foot 23, two feet 24 and three feet 25 long. This will allow an incremental construction so that vertical joints are overlapped by a continuity of panel and its slot above and below the junction of the vertical strips with the horizontal strips 16. However, in corner applications an outside corner panel 17 must be made shorter by the panel thickness and an inside corner panel 14 must be lengthened by the panel thickness.

This invention is manufactured by using rectangular molds made of steel or wood. The embedded fastener 3 is positioned in the wet concrete in the mold. The embedded fasteners 3 are fabricated from a perforated material such as expanded steel.

What is claimed is:

1. An assembly for constructing a building wall structure, said assembly comprising:

a generally planar cast panel defining a pair of opposed surfaces joined by a plurality of edge faces, at least one of said edge faces defining a slot for receiving a connecting strip for joining an adjacent one of said panels;

at least one embedded member protruding from one of said surfaces, wherein said embedded member is a generally planar perforated material for receiving a fastener to join an overlapped embedded member from another of said panels which is spaced and parallel to said panel.

2. The assembly of claim 1, wherein a plurality of said edge faces defines a slot for receiving a strip for joining together a plurality of said panels.

3. The assembly of claim 1, wherein said panel defines an opening for a door.

4. The assembly of claim 1, wherein said panel defines an opening for a window.

5. The assembly of claim 1, wherein said panel includes a surface slot in one of said surfaces adjacent and parallel to one of said edge faces for receiving a connecting strip for engaging another of said panels to form a corner structure.

6. The assembly of claim 1, wherein said perforated material is expanded metal.

7. The assembly of claim 1, wherein said at least one embedded member is a plurality of embedded members.

8. The assembly of claim 1, wherein the cast panel is formed from lightweight concrete.

9. A wall structure for use in constructing a building, said wall structure comprising:

a plurality of generally planar cast panels, each of said panels defining a pair of opposed surfaces joined by a plurality of edge faces, at least one of said edge faces defining a slot for receiving a connecting strip for joining an adjacent one of said panels, at least one embedded member protruding from one of said surfaces of each of said panels, wherein each said embedded member is a generally planar perforated material;

a pair of said panels being in laterally spaced, generally parallel relationship, and being positioned such that said embedded members from each of said pair of said panels overlap;

a connection structure between said embedded members of pair of said panels such that said embedded members of said pair of said panels are securely joined together; and a connecting strip positioned in one of said slots.

10. The wall structure of claim 9, further including a third of said panels positioned such that a slot of said third panel engages said connecting strip.

11. The wall structure of claim 9, wherein a plurality said edge faces defines a slot for receiving a strip for joining together a plurality of said panels in edge face-to-edge face relation.

12. The wall structure of claim 9, wherein at least one of said panels defines an opening for a door.

13. The wall structure of claim 9, wherein at least one of said panels defines an opening for a window.

14. The wall structure of claim 9, wherein one of said panels includes a surface slot in one of said surfaces adjacent and parallel to one of said edge faces, a connecting strip received in said surface slot, wherein said connecting strip in said surface slot joins another of said panels to form a corner structure.

15. The wall structure of claim 9, wherein said perforated material is expanded metal.

16. The wall structure of claim 9, wherein said at least one embedded member is a plurality of embedded members.

17. The wall structure of claim 9, wherein said connection structure is selected from the group comprising: a nut, bolt and washer combination; a rivet; and a spot weld.

18. The wall structure of claim 9, wherein the cast panels are formed from lightweight concrete.

* * * * *